US010143057B2

(12) United States Patent
Lin

(10) Patent No.: US 10,143,057 B2
(45) Date of Patent: Nov. 27, 2018

(54) BOARD-MOUNTED PARALLEL CIRCUIT STRUCTURE WITH EFFICIENT POWER UTILIZATION

(71) Applicant: Hung Lin, Keelung (TW)

(72) Inventor: Hung Lin, Keelung (TW)

( * ) Notice: Subject to any disclaimer, the term of this patent is extended or adjusted under 35 U.S.C. 154(b) by 855 days.

(21) Appl. No.: 14/589,015

(22) Filed: Jan. 5, 2015

(65) Prior Publication Data

US 2016/0198539 A1 Jul. 7, 2016

(51) Int. Cl.
*H05B 33/08* (2006.01)

(52) U.S. Cl.
CPC ..... *H05B 33/0857* (2013.01); *H05B 33/0824* (2013.01)

(58) Field of Classification Search
CPC ..... H05B 17/0218; H05B 33/0815; H05B 33/0845; H05B 33/0854; H05B 33/0887; H05B 37/0272
See application file for complete search history.

(56) References Cited

U.S. PATENT DOCUMENTS 8,536,780 B2 9/2013 Wakimoto
9,209,353 B2 12/2015 Radermacher
2011/0199021 A1* 8/2011 Oyaizu ..... H05B 33/0884 315/294
2013/0112955 A1* 5/2013 Yamazaki ..... H01L 51/5228 257/40
2014/0048777 A1* 2/2014 Lin ..... H01L 51/5203 257/40
2014/0334137 A1* 11/2014 Hasenoehrl ..... H01L 25/0753 362/147

FOREIGN PATENT DOCUMENTS

KR 10-2010-0054756 5/2010
KR 10-2011-0062333 6/2011
KR 10-2012-0090474 8/2012

* cited by examiner

*Primary Examiner* — Jimmy Vu
*Assistant Examiner* — Laura Yesildag
(74) *Attorney, Agent, or Firm* — Alan D. Kamrath; Kamrath IP Lawfirm, P.A.

(57) ABSTRACT

A board-mounted parallel circuit structure with efficient power utilization includes a first substrate, a first constant voltage layer and a second constant voltage layer. The first and second constant voltage layers are connected to a power supply respectively through two power connection points. The first constant voltage layer has at least one insulating zone. Each insulating zone has a light-emitting unit formed therein. One electrode of the light-emitting unit is connected to the first constant voltage layer, and the other electrode thereof is connected to the second constant voltage layer through a conducting wire. When the power supply outputs a low voltage to the first constant voltage layer, resistance values everywhere on the first constant voltage layer are identical. Accordingly, given any distance between a light-emitting unit and a corresponding power connection point, lighting efficiency of the light-emitting unit is not affected and effective power utilization can be ensured.

13 Claims, 4 Drawing Sheets

BOARD-MOUNTED PARALLEL CIRCUIT STRUCTURE WITH EFFICIENT POWER UTILIZATION

BACKGROUND OF THE INVENTION

1. Field of the Invention

The present invention relates to a parallel circuit structure and, more particularly, to a board-mounted parallel circuit structure with efficient power utilization.

2. Description of the Related Art

Regular circuit structures in lighting applications mostly pertain to circuit structure of a single substrate. The circuit structure is normally fabricated on a single substrate. In view of the positive and negative power terminals of a single substrate all formed on an identical plane, different voltages vary from location to location at wires depending on how far the distance from the measured point to the positive or negative terminal is. The farther the measured point is away from the power source is, the higher the resistance value is measured at the point. While the resistance value to a measured point on the circuit structure increases, a resulting voltage drop to the measured point also increases to cause lower luminance of a lighting module, such as an LED (Light-emitting Diode), and to cause worse power utilization efficiency.

Conventional types of driving circuits for lighting include a parallel circuit, a series circuit and a compound circuit. With reference to FIG. 3, a conventional parallel circuit for a lighting driving circuit is connected in series between the positive and negative electrodes of a power supply and has multiple light-emitting modules connected in parallel to each other. Each light-emitting module is composed of a circuit loop including a light-emitting diode (LED) 91 and a resistor R. With reference to FIG. 4, multiple series circuits and a compound circuit are illustrated. The series circuit includes multiple LEDs 91 connected in series to each other. The compound circuit is formed by connecting the multiple series circuits .in parallel to each other, and is connected between the positive and negative electrodes of a power supply.

A conventional AC (Alternating Current) driven LED circuit includes a full-wave rectifier, a compensation module, an LED module and a lighting efficiency enhancing module. The full-wave rectifier has at least four LED units arranged in the form of a full bridge to provide two output terminals. The compensation module has four compensation capacitors connected in parallel between two terminals of each LED unit. The LED module is connected to the two output terminals of the full-wave rectifier, and includes an LED string having multiple LEDs connected in series to each other. The lighting efficiency enhancing module includes at least one capacitor connected in parallel between two terminals of the LED module.

As can be seen from the foregoing technique, the wiring length on a single substrate certainly affects lighting luminance and power utilization efficiency, and each light-emitting module of the parallel circuit needs to be connected in parallel to a resistor R to limit current. However, the drawbacks of the parallel circuit reside in high cost and overheating issues because of high operating voltage. The series circuit and the compound circuit also need to boost voltage for all the LEDs to have the same luminance and thus consume more power. Especially when one of the LEDs 91 fails and an open circuit is caused, all other LEDs 91 in the same LED string become not operable. Although the use of the compensation module and the lighting efficiency enhancing module can increase luminance, efficiently utilize power, and lower the risk of LED damage, higher cost still arises from the additional compensation module and the lighting efficiency enhancing module, thus failing to ensure cost-effectiveness to manufacturers in the related industry.

SUMMARY OF THE INVENTION

An objective of the present invention is to provide a board-mounted parallel circuit structure with efficient power utilization, targeting at forming a circuit on different surfaces of one or more substrates with stable lighting efficiency for the purpose of reduction in electronic components needed, lower production cost and effective power utilization.

To achieve the foregoing objective, the board-mounted parallel circuit structure with efficient power utilization has a first substrate, a second constant voltage layer and at least one light-emitting unit.

The first substrate has a first constant voltage layer. The first constant voltage layer has a first power connection point and at least one insulating zone.

The first power connection point is formed on one edge portion of the first constant voltage layer.

The at least one insulating zone is formed on the first constant voltage layer.

The second constant voltage layer has a second power connection point formed on one edge portion of the second constant voltage layer.

Each one of the at least one light-emitting unit is formed within a corresponding insulating zone and has a positive terminal and a negative terminal. One of the positive terminal and the negative terminal of the light-emitting unit is electrically connected to the first constant voltage layer, and the other one of the positive terminal and the negative terminal of the light-emitting unit is electrically connected to the second constant voltage layer.

Given the foregoing circuit structure, the first substrate has a first constant voltage layer, and the first constant voltage layer having the first power connection point formed on one edge portion thereof and the second constant voltage layer having the second power connection point formed on one edge portion thereof are connected to a power supply through the first and second power connection points. The first constant voltage layer has at least one insulating zone formed thereon, and each insulating zone has a light-emitting unit formed therein with one of a positive terminal and a negative terminal of the light-emitting unit electrically connected to the first constant voltage layer and the other one of the positive terminal and the negative terminal electrically connected to the second constant voltage layer. When the power supply outputs a low voltage to the first constant voltage layer of the first substrate, resistance values everywhere on the first constant voltage layer are identical. Hence, regardless of how far the distance between a light-emitting unit and the first power connection point is, the way of the power supply driving the at least one light-emitting unit and maintaining a stable lighting efficiency of the at least one light-emitting unit won't be affected, thereby ensuring effective power utilization.

Other objectives, advantages and novel features of the invention will become more apparent from the following detailed description when taken in conjunction with the accompanying drawings.

DETAILED DESCRIPTION OF THE INVENTION

Figure 1:
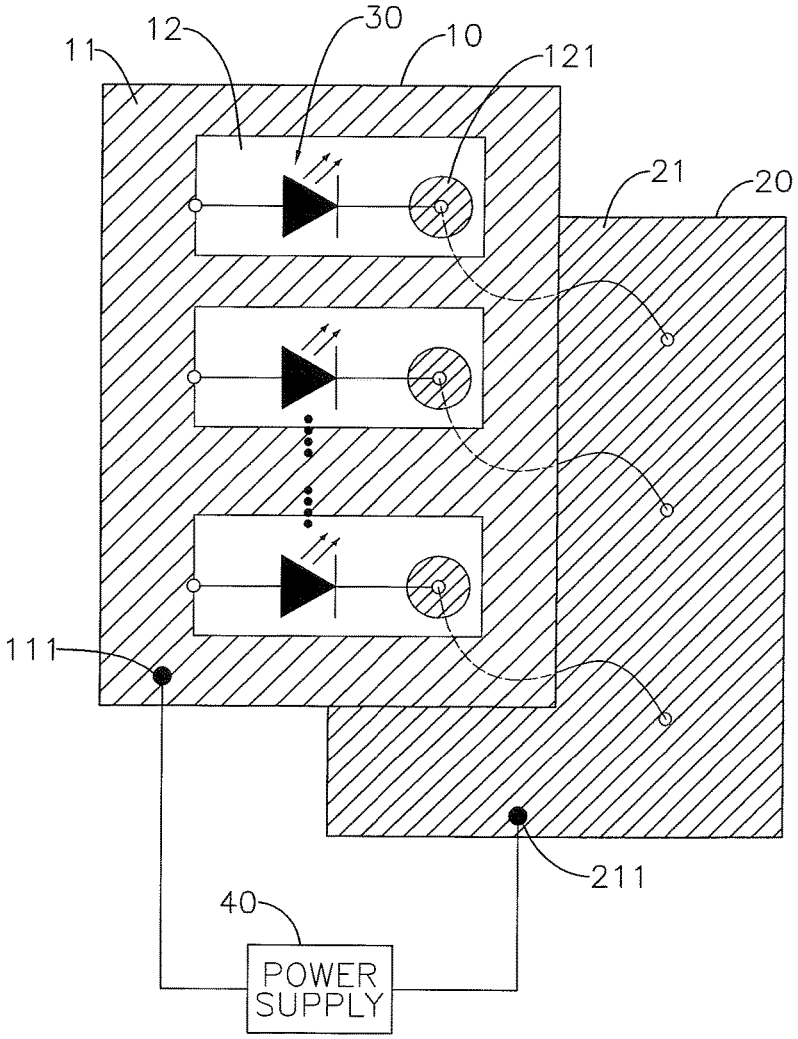
FIG. 1 is a circuit diagram of a first embodiment of a board-mounted parallel circuit structure with efficient power utilization in accordance with the present invention.

With reference to FIG. 1, a first embodiment of a board-mounted parallel circuit structure with efficient power utilization in accordance with the present invention includes a first substrate 10, a second substrate 20, at least one light-emitting unit 30 and a power supply 40. The power supply 40 has a positive output terminal and a negative output terminal.

The first substrate 10 has a first surface, a first constant voltage layer 11 and a first power connection point 111. The first constant voltage layer 11 is formed on the first surface of the first substrate 10. The first power connection point 111 is formed on a point on the first constant voltage layer 11 and is adjacent to one edge portion of the first constant voltage layer 11. The second substrate 20 has a second surface, a second constant voltage layer 21 and a second power connection point 211. The second constant voltage layer 21 is formed on the second surface of the second substrate 20. The second power connection point 211 is formed on a point on the second constant voltage layer 21 and is adjacent to one edge portion of the second constant voltage layer 21. The first constant voltage layer 11 is connected to the positive output terminal of the power supply 40 through the first power connection point 111. The second constant voltage layer 21 is connected to the negative output terminal of the power supply 40 through the second power connection point 211. In the present embodiment, each of the first constant voltage layer 11 and the second constant voltage layer 21 is formed by a layer of metal coating.

It has to be pointed out that the first constant voltage layer 11 and the second constant voltage layer 21 can also be formed on two opposite surfaces of a single substrate. Although the first constant voltage layer 11 and the second constant voltage layer 21 are respectively formed on the first substrate 10 and the second substrate 20 in the present embodiment, implementation of the first constant voltage layer 11 and the second constant voltage layer 21 is not limited to formation on two substrates.

The first constant voltage layer 11 of the first substrate 10 includes at least one insulating zone 12. Each one of the at least one insulating zone 12 has at least one light-emitting unit 30. Each one of the at least one light-emitting unit 30 has a positive terminal and a negative terminal opposite to each other. The positive terminal and the negative terminal of the light-emitting diode 30 are respectively and electrically connected to the first constant voltage layer 11 and the second constant voltage layer 21.

The first power connection point 111 of the first constant voltage layer 11 is connected to the positive output terminal of the power supply 40. The second power connection point 211 of the second constant voltage layer 21 is connected to the negative output terminal of the power supply 40. The positive terminal and the negative terminal of each one of the at least one light-emitting unit 30 are respectively and electrically connected to the first constant voltage layer 11 and the second constant voltage layer 12, such that the positive electrode and the negative electrode of the circuit loop are respectively located on two different surfaces of the first substrate 10 and the second substrate 20, and such that resistance values everywhere on the first constant voltage layer 11 are roughly identical. Hence, regardless of whether a distance between each one of the at least one light-emitting unit 30 and the first power connection point 111 is far or near, power supplied from the power supply 40 and a lighting efficiency of the light-emitting unit 30 remain the same, thereby achieving the goal of effective power utilization.

In the present embodiment, the first constant voltage layer 11 of the first substrate 10 includes multiple insulating zones 12. Each insulating zone 12 has a light-emitting unit 30. The negative terminal of each light-emitting unit 30 is electrically connected to the second constant voltage layer 21 through a conducting wire. The first substrate 10 and the second substrate 20 are rectangular and sheet-like, and each of the first substrate 10 and the second substrate 20 has two parallel first long sides and two parallel first short sides. The multiple insulating zones 12 are arranged as a column on the first constant voltage layer 11 in a direction along the first long side and are spaced apart from each other by gaps. Each light-emitting unit 30 is formed inside a corresponding insulating zone 12, is rectangular, and has two parallel second long sides and two parallel second short sides. The positive terminal of the light-emitting unit 30 is formed on one of the two second short sides of the corresponding insulating zone 12, and is electrically connected to the first constant voltage layer 11 of the first substrate 10. The negative terminal of the light-emitting unit 30 is formed on a position in the corresponding insulating zone 12 adjacent to the other second short side, and is electrically connected to the second constant voltage layer 21 of the second substrate 20 through a corresponding conducting wire. The insulating zone 12 may further have a conducting layer 121 formed within the insulating zone 12. The conducting layer 121 is located between the negative terminal of the light-emitting unit 30 and the other second short side of the insulating zone 12, and is electrically connected between the negative terminal of the light-emitting unit 30 and the corresponding conducting wire. The conducting layer 121 is round and serves to increase conductivity of the light-emitting unit 30 and the second constant voltage layer 21 through the corresponding conducting wire. The conducting layer 121 may be a layer of metal coating. Each light-emitting unit 30 may be an LED (Light-emitting Diode) unit, which may be a single-core LED, a dual-core LED or a multi-core LED.

Figure 2:
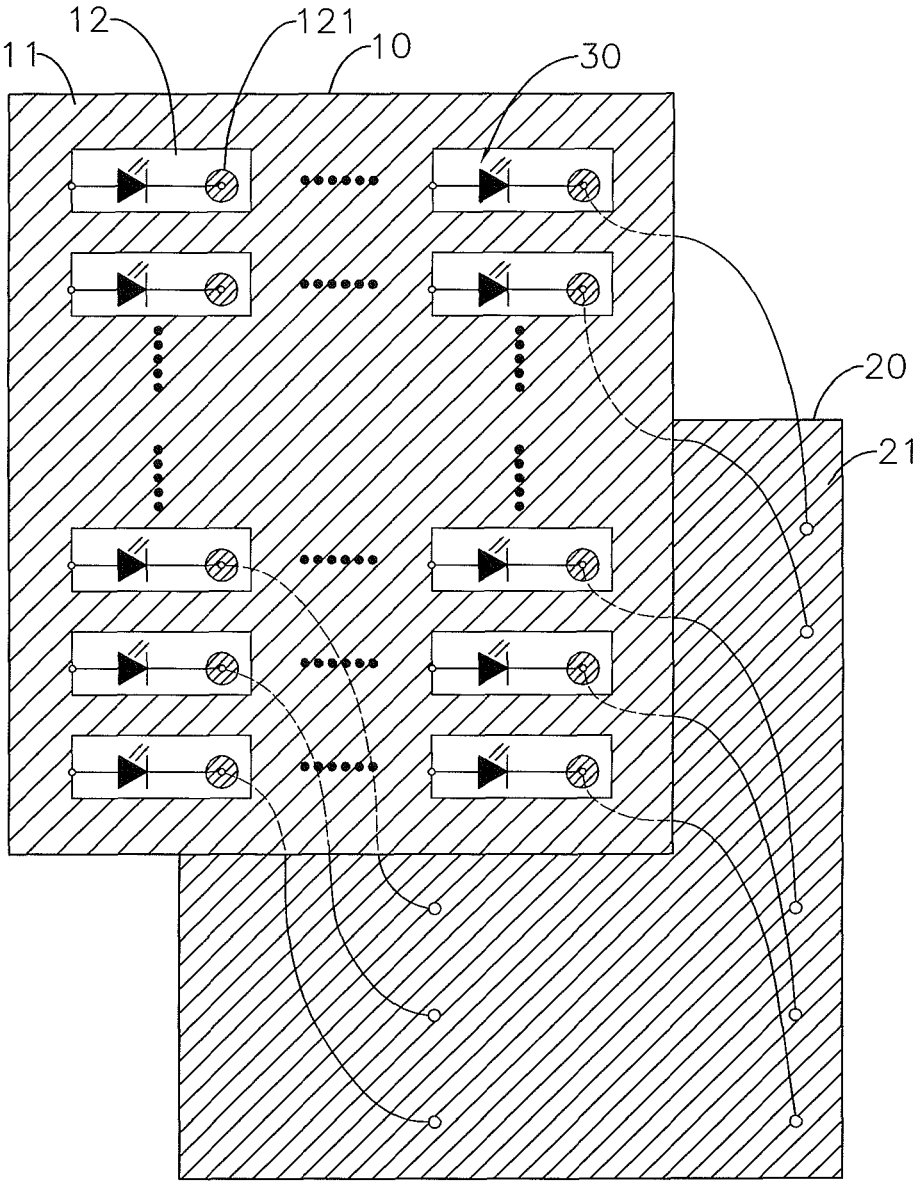
FIG. 2 is a circuit diagram of a second embodiment of a board-mounted parallel circuit structure with efficient power utilization in accordance with the present invention.
Figure 3:
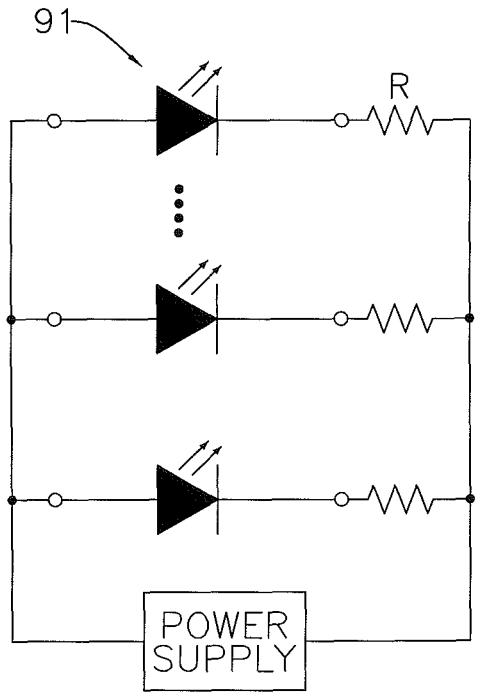
FIG. 3 PRIOR ART
FIG. 3 is a circuit diagram of a conventional lighting driving circuit.
Figure 4:
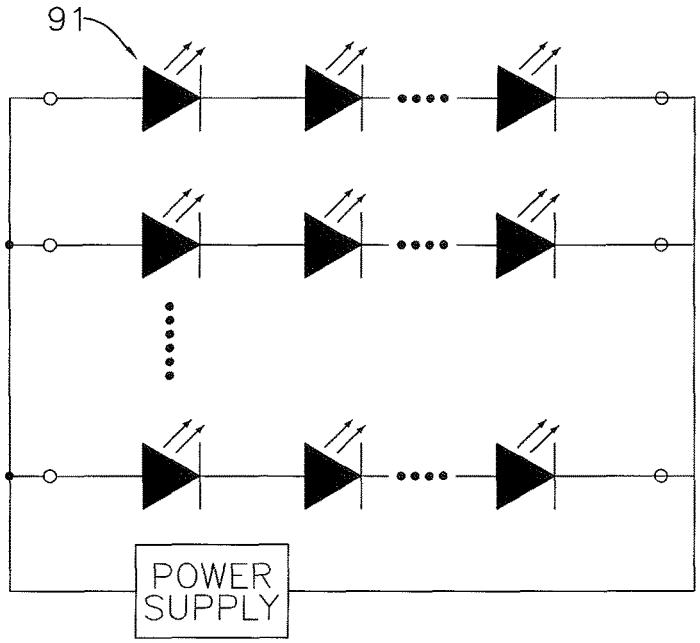
FIG. 4 PRIOR ART
FIG. 4 is a circuit diagram of another conventional lighting driving circuit.

With reference to FIG. 2, a second embodiment of a board-mounted parallel circuit structure with efficient power utilization in accordance with the present invention is substantially the same as the foregoing embodiment except the sizes of the first substrate 10 and the second substrate 20, the position, quantity and arrangement of the insulation zone 12, and the quantity of the light-emitting unit 30. The areas of the first substrate 10 and the second substrate 20 in the present embodiment are larger than those in the foregoing embodiment and expand in both the first long sides and the first short sides and in both the second long sides and the second short sides for more insulating zones 12 to be formed on the first substrate 10 and allow more light-emitting units 30 to be formed within the insulating zones 12. The total insulating zones 12 are arranged on the first substrate 10 as multiple rows along the first short sides and are spaced apart from each other by gaps. The total insulating zones 12 are formed on the first substrate 10 in the form of an M×N array with each light-emitting unit 30 formed in one of the insulating zones 12, which pertains to one element of the M×N array.

In sum, the first substrate 10 and the second substrate 20 respectively have the first constant voltage layer 11 and the second constant voltage layer 21 formed thereon, the first constant voltage layer 11 has a first power connection point 111 on one edge portion thereof, and the second constant voltage layer 21 has a second power connection point 211 on one edge portion thereof with the first power connection point 111 and the second power connection point 211 connected to the power supply 40. The first constant voltage layer 12 has at least one insulating zone 12 or an M x N array of insulating zones 12 formed thereon with each light-emitting unit 30 formed within a corresponding insulating zone 12. The positive and negative terminals of each light-emitting unit 30 are respectively and electrically connected to the first constant voltage layer 11 and the second constant voltage layer 21. When the power supply 40 outputs a low voltage, such as 2.5~3.5 Vf (Voltage-forward) for a single-core LED, to drive the at least one light-emitting unit 30, and as the resistance values everywhere on the first constant voltage layer 11 are approximately the same, no significant difference in voltage drop across the at least one light-emitting unit 30 on the first substrate 10 is generated no matter how far the at least one light-emitting unit 30 is located from the first power connection point 111. Accordingly, the at least one light-emitting unit 30 consumes almost the same power in terms of voltage (Vf), current (If (Current Forward)) and wattage (W) to generate the identical lighting efficiency without requiring additional modules or electronic elements, thereby achieving the goal of enhancing power utilization efficiency indeed.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A board-mounted parallel circuit structure with efficient power utilization, comprising:

a first substrate having a first constant voltage layer, wherein the first constant voltage layer has: a first power connection point formed on one edge portion of the first constant voltage layer and multiple insulating zones formed on the first constant voltage layer;

a second constant voltage layer having a second power connection point formed on one edge portion of the second constant voltage layer;

a power supply having a positive output terminal and a negative output terminal and outputting a power at a voltage range of 2.5 volts (V) to 3.5 volts (V); and multiple light-emitting units disconnected from each other but each light-emitting unit connected separately in parallel with the power supply, with each light-emitting unit being a light-emitting diode (LED) unit implemented by an LED core technology and formed within a corresponding insulating zone and having a positive terminal and a negative terminal, wherein the positive terminal of each light-emitting unit is formed on an edge of the corresponding insulating zone and is electrically connected to the first constant voltage layer, wherein the negative terminal of each light-emitting unit is formed on a position in the corresponding insulating zone and is electrically connected to the second constant voltage layer through a conducting wire, wherein the first constant voltage layer is electrically connected to the positive output terminal of the power supply through the first power connection point, wherein the second constant voltage layer is electrically connected to the negative output terminal of the power supply through the second power connection point, and wherein the positive terminal of each of the multiple light-emitting units are connected in parallel to the positive output terminal of the power supply through the first constant voltage layer and the negative terminal of each of the multiple light-emitting units are connected in parallel to the negative output terminal of the power supply through the respective conducting wires and the second constant voltage layer, wherein each insulating zone further has a conducting layer formed within the insulating zone and electrically connected between the negative terminal of the light-emitting unit and the conducting wire, wherein the first substrate is rectangular comprising two long sides and two short sides, wherein the multiple insulating zones are formed on the first constant voltage layer in a direction along the two long sides, wherein an area of the first substrate expands in directions along the two long sides and the two short sides of the first substrate for the multiple insulating zones to be arranged along the two long sides and the two short sides of the first substrate to form an array of insulating zones with each insulating zone having a corresponding light-emitting unit formed within the insulating zone of the array of insulating zones, wherein when the power supply outputs the power to drive the multiple light-emitting units, an identical voltage drop across the multiple light-emitting units on the first substrate is generated and resistance values everywhere on the first constant voltage layer are the same.

2. The board-mounted parallel circuit structure as claimed in claim 1, wherein when the power supply outputs the power to drive the multiple light-emitting units, an identical voltage drop across the multiple light-emitting units on the first substrate is generated and resistance values everywhere on the first constant voltage layer are the same.

3. The board-mounted parallel circuit structure as claimed in claim 2, wherein each of the first constant voltage layer, the second constant voltage layer and the conducting layer of each insulating zone is formed by a layer of metal coating.

4. The board-mounted parallel circuit structure as claimed in claim 1, wherein each of the first constant voltage layer, the second constant voltage layer and the conducting layer of each insulating zone is formed by a layer of metal coating.

5. The board-mounted parallel circuit structure as claimed in claim 3, wherein the LED unit is one of a single-core LED, a dual-core LED and a multi-core LED.

6. The board-mounted parallel circuit structure as claimed in claim 4, wherein the LED unit is one of a single-core LED, a dual-core LED and a multi-core LED.

7. The board-mounted parallel circuit structure as claimed in claim 1, further comprising a second substrate having two long sides and two short sides, wherein the second constant voltage layer is formed on the second substrate.

8. The board-mounted parallel circuit structure as claimed in claim 1, further comprising a second substrate having two long sides and two short sides with an area of the second substrate expanding in directions along the two long sides and the two short sides of the second substrate, wherein the second constant voltage layer is formed on the second substrate.

9. The board-mounted parallel circuit structure as claimed in claim 1, further comprising a second substrate having two long sides and two short sides with an area of the second substrate expanding in directions along the two long sides and the two short sides of the second substrate, wherein the second constant voltage layer is formed on the second substrate.

10. The board-mounted parallel circuit structure as claimed in claim 1, further comprising a second substrate having two long sides and two short sides with an area of the second substrate expanding in directions along the two long sides and the two short sides of the second substrate, wherein the second constant voltage layer is formed on the second substrate.

11. The board-mounted parallel circuit structure as claimed in claim 2, further comprising a second substrate having two long sides and two short sides with an area of the second substrate expanding in directions along the two long sides and the two short sides of the second substrate, wherein the second constant voltage layer is formed on the second substrate.

12. The board-mounted parallel circuit structure as claimed in claim 1, further comprising a second substrate having two long sides and two short sides with an area of the second substrate expanding in directions along the two long sides and the two short sides of the second substrate, wherein the second constant voltage layer is formed on the second substrate.

13. The board-mounted parallel circuit structure as claimed in claim 3, further comprising a second substrate having two long sides and two short sides with an area of the second substrate expanding in directions along the two long sides and the two short sides of the second substrate, wherein the second constant voltage layer is formed on the second substrate.

* * * * *